United States Patent [19]

Månström

[11] Patent Number: 4,688,489

[45] Date of Patent: Aug. 25, 1987

[54] PIVOTAL BRIDGE PLATE BETWEEN LATERALLY TILTABLE DUMPING WAGON BODIES

[75] Inventor: Hilding Månström, Luleå, Sweden

[73] Assignee: Luossavaara-Kiirunavaara AB, Luleå, Sweden

[21] Appl. No.: 822,423

[22] PCT Filed: Mar. 18, 1985

[86] PCT No.: PCT/SE85/00123

§ 371 Date: Nov. 15, 1985

§ 102(e) Date: Nov. 15, 1985

[87] PCT Pub. No.: WO85/04138

PCT Pub. Date: Sep. 26, 1985

[30] Foreign Application Priority Data

Mar. 19, 1984 [SE] Sweden ..... 8401508

[51] Int. Cl.[4] ..... B61D 9/12

[52] U.S. Cl. ..... 105/279

[58] Field of Search ..... 105/239, 241.1, 241.2, 105/247, 248, 261 R, 264, 268, 270, 279, 458, 265, 266, 267; 198/708

[56] References Cited

U.S. PATENT DOCUMENTS

| | | | |
|---|---|---|---|
| 647,750 | 4/1900 | Hunt | 198/708 |
| 720,923 | 2/1903 | Ingoldsby | 105/379 |
| 1,829,560 | 10/1931 | Kantenwein | 105/239 |
| 2,651,268 | 9/1953 | Casciano | 105/379 |
| 3,166,022 | 1/1965 | Flowers | 105/279 X |
| 3,228,355 | 1/1966 | Black | 105/458 |
| 3,370,552 | 2/1968 | DePodesta et al. | 105/458 X |
| 3,403,636 | 10/1968 | Andrews | 105/241.1 X |
| 3,610,165 | 10/1971 | Browne et al. | 105/247 X |
| 3,842,967 | 10/1974 | Davis | 198/708 |
| 4,077,328 | 3/1978 | Taylor | 105/261 A |
| 4,351,243 | 9/1982 | Brouwer | 105/241.2 |

FOREIGN PATENT DOCUMENTS

| | | | |
|---|---|---|---|
| 2812189 | 9/1979 | Fed. Rep. of Germany | 198/708 |

*Primary Examiner*—Robert B. Reeves
*Assistant Examiner*—Charles Barrett
*Attorney, Agent, or Firm*—Cushman, Darby & Cushman

[57] ABSTRACT

Apparatus for bridging a space between adjacent wagons having laterally tiltable bodies and arranged end to end in a train includes a flap pivoted at the rear end of a wagon body for free pivotal movement about a horizontal transverse axis, the flap having a width corresponding to that of the respective wagon body and a length sufficient to overlap the following wagon body.

2 Claims, 4 Drawing Figures

PIVOTAL BRIDGE PLATE BETWEEN LATERALLY TILTABLE DUMPING WAGON BODIES

This invention relates to a device at a set of wagons having laterally tiltable bodies for bridging the space between the wagon bodies.

At laterally tiltable wagon bodies one is at present compelled to use so-called intermittent loading, i.e. the wagon body is advanced to a position beneath e.g. a loading hopper, after which the wagon body is stopped and loading takes place. The next wagon body is thereafter driven up.

This type of loading is extraordinarily time-consuming due to the continual stops and starts of the wagon set which must be made. Moreover, said stops and starts involve an unnecessary stress on the material.

Thus, it is desirable that so-called continuous loading can be used which, however, cannot be done as, in that case, an unacceptable wastage would result due to the goods falling down between the wagon bodies.

It is the object of this invention to provide a device of the kind mentioned above, which enables a continuous loading of the wagon bodies without any appreciable spill. This is realized in an utterly simple and elegant way by means of a device having the characteristic features set out in the appended claims.

Figure 1:
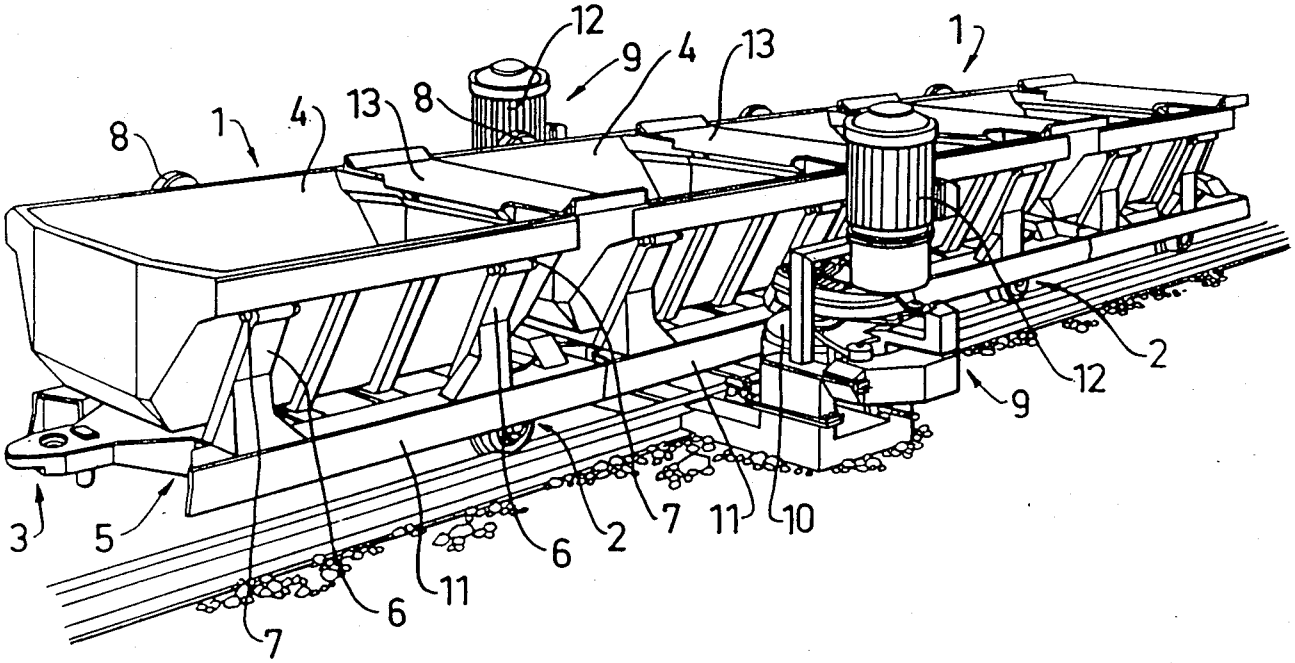
Figure 2C:
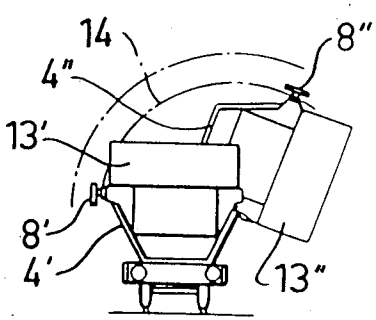
Figure 2A:
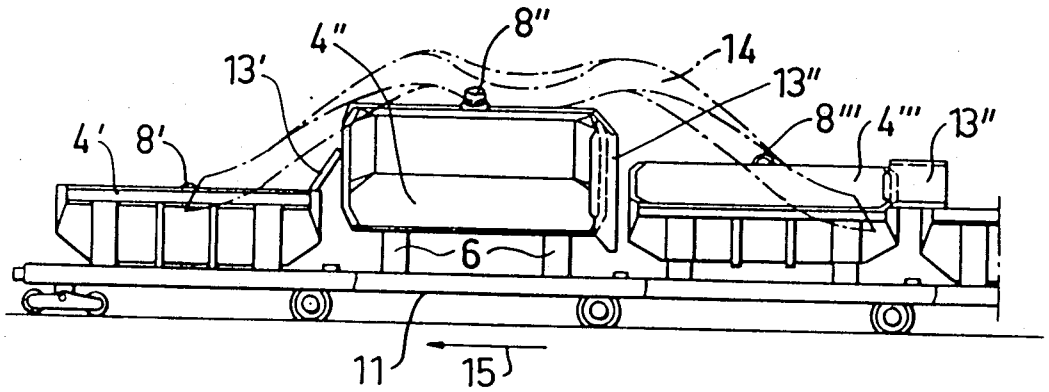
Figure 2B:
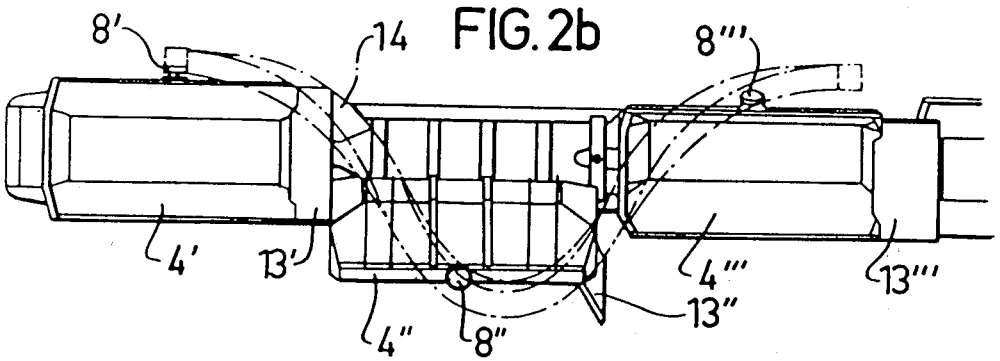

An illustrative example of the invention will be described below with reference to the enclosed drawings, wherein FIG. 1 shows a set of wagons with laterally tiltable bodies provided with devices according to the invention and FIGS. 2*a*, 2*b* and 2*c* show the dumping of laterally tiltable wagon bodies, which are provided with devices according to the invention.

The set of wagons shown in FIG. 1 comprises four wagons 1, which are coupled together with so-called 3-point suspension. This means that the wagons 1 have a wheel pair 2 only in the region of one of their ends while their other ends are provided with a tension flange 3, which at coupling of the wagons is hooked onto a tow hook or the like of an adjoining wagon. Thanks to said 3-point suspension the set of wagons will have a good flexibility with little risk of derailment on a roughly laid rail.

The wagon bodies 4 rest on underframes 5. Each underframe 5 has two upright support means 6 placed along one long side of the underframe and sloping outwardly relative to the longitudinal center line of the set of wagons.

At the upper ends of the support means 6 hinges 7 are arranged, which connect the wagon bodies 4 with the support means 6. Thanks to this constructive embodiment the wagon body 4 can be tilted laterally at emptying, which will be described more in detail below.

On the long side turned from the hinges 7 the wagon bodies 4 also shown a guide roller 8, which is used in connection with the tipping of the wagon bodies.

In the illustrative example shown two opposed electric drive stations 9 are arranged on both sides of the set of wagons for its propulsion. Said drive stations 9 each have a drive roller 10 mounted on a vertical shaft, which cooperates with a side member 11 of the underframe 5. The drive roller is rotated by means of an electric motor 12 of the drive station 9.

The distance between two adjacent wagon bodies 4 is bridged by a flap 13, which is pivotably attached to one wagon body while its abuts loosely from above against the other wagon body. Due to the arrangement of said flaps 13 a continuous goods receiving line along the entire set of wagons is formed. Thanks to this a so-called continuous loading can be utilized. The goods thereby getting onto the flaps 13 either remain there or fall down by vibration or the like into the adjoining wagon bodies 4. Raised lateral edges 13*a* of the flaps 13 ensure that goods will not fall down laterally.

When emptying the set of wagons described above each wagon passes an emptying station at which a so-called emptying helix 14 is arranged, see FIGS. 2*a*–2*c*.

The direction of travel of the set of wagons is shown by the arrow 15 in FIG. 2*a*.

When the set of wagons appears at the emptying station guide rollers 8''' of the right wagon body 4''' in FIGS. 2*a* and 2*b* will be entered into the emptying helix 14 at its right end in FIGS. 2*a* and 2*b*. By cooperation between the emptying helix 14 and the guide roller 8''' the wagon body 4''' will be swiveled about the hinges 7. The flap 13''' pivotably arranged at said wagon body will then accompany the tilting movement of the wagon body 4''' (the right position in FIGS. 2*a* and 2*b*).

At additional movement of the set of wagons in the direction of the arrow 15 tilting movement of the wagon body 4''' is continued until the latter has reached the intermediate emptying position in FIGS. 2*a* and 2*b* and the right emptying position in FIG. 2*c*, respectively. The goods will then tumble out of the wagon body 4'' and down into an emptying hopper or the like. Due to the force of gravity the flap 13'' will be turned to the left in FIGS. 2*a* and 2*b*, whereby it is ensured that the goods possibly lying thereon will also fall down into the emptying hopper.

When the intermediate wagon body 4'' in FIGS. 2*a* and 2*b* has emptied its goods it will be returned to the position entered by the left wagon body 4' in FIGS. 2*a* and 2*b* by the influence of the emptying helix 14 at the continued motion of the wagon set. In a certain position of the returning movement of the wagon body 4'' the flap 13''will be turned back to a position where it extends straight outwards laterally from the wagon body 4, see the right flap 13''' in FIG. 2*a*.

At said return of the wagon body 4'' the associated flap 13'' will be caught by the rear wagon body 4''' going up by the action of the emptying helix 14. Thus, the flap 13'' will enter a position where its free edge is upwardly turned and abuts the rear wagon body, which is then approaching its emptying position. The free edge of the flap 13'' thus slides along the short side of the rear wagon body.

When the wagon body 4'' being in the intermediate position has emptied its goods it will be tilted by the action of the emptying helix 14 back to the position entered by the left wagon body 4' in FIGS. 2*a* and 2*b*. The end section of the wagon body 4'' will then slide relative to the flap 13' of the wagon body 4'. By making the end sections of the wagon bodies 4 relatively smooth the risk is eliminated that the flap 13' will hook onto said end section due to the friction between the free edge of the flap 13' and the front end section of the wagon body 4''. When the wagon body 4'' has been tilted back to the position of the wagon body 4' in FIGS. 2*a* and 2*b* the flap 13' will fall down above the front end of the wagon body. By this the wagon body 4' and the flap 13' have again entered the starting position in which loading of goods can take place.

As is most clearly apparent from FIG. 1 the flap 13 has raised lateral edges lengthwise of the wagon set. In this way the risk of wastage of the goods getting onto the flap 13 at loading will be reduced.

The invention is by no means restricted to the illustrative example described above but can be freely varied within the scope of the appended claims.

I claim:

1. In a train including at least a front wagon and a rear wagon each having a frame and a body which is tiltable laterally relative to its frame from an upright position to a tilted position for emptying the respective wagon and each wagon body having a front end wall facing in the direction of train travel and a rear end wall and there being a space between the rear end wall of the front wagon body and the front end wall of the rear wagon body; a flap pivoted to the upper edge of the rear end of the front wagon for free swinging movement about an axis transverse to the direction of train travel, said flap having a free edge remote from said axis, a width dimension equal to the width dimension of the respective wagon body and a length dimension such that said free edge overlies and is supported by the upper edge of the front end wall of the rear wagon body when the wagons are in their upright positions whereby the flap is generally horizontal and bridges said space, the arrangement being such that when the forward wagon body is tilted laterally to dump its contents, the respective flap will freely pivot about said axis and also dump any material which has collected on its upper surface and such that when the forward wagon body returns to its upright position the flap freely pivots so as to engage and slide along the front wall of the rear wagon body and subsequently return to its generally horizontal position in which its free edge is supported on the upper edge of front end wall of the rear wagon body and the arrangement being such that when the rear wagon body is tilted laterally to dump its contents, the respective flap will freely pivot about its axis and engage and slide along the rear wall of the front wagon body.

2. The device as claimed in claim 1, characterized in that the edges of the flap (13) extending in the longitudinal direction of the train are raised.

* * * * *